United States Patent [19]

Bishop et al.

[11] Patent Number: 4,944,429

[45] Date of Patent: Jul. 31, 1990

[54] MANUALLY-OPERABLE SPRAY DISPENSER WITH LOCKING MECHANISM

[75] Inventors: Keith H. Bishop, River Vale; William S. Blake, Linwood, both of N.J.

[73] Assignee: Schering Corporation, Kenilworth, N.J.

[21] Appl. No.: 90,490

[22] Filed: Aug. 28, 1987

[51] Int. Cl.[5] ..... B67D 5/32

[52] U.S. Cl. ..... 222/153; 222/182; 222/321; 222/384; 239/333

[58] Field of Search ..... 222/153, 321, 383, 384, 222/385, 402.11, 402.12, 402.13, 562, 182; 239/333

[56] References Cited

U.S. PATENT DOCUMENTS

| | | | |
|---|---|---|---|
| 2,831,613 | 4/1958 | Soffer | 222/402.11 X |
| 3,841,533 | 10/1974 | Carroll et al. | 222/402.13 |
| 4,162,746 | 7/1979 | Anderson et al. | 222/384 X |
| 4,496,082 | 1/1985 | Corsette | 222/384 X |
| 4,565,302 | 1/1986 | Pfeiffer et al. | 222/321 X |
| 4,620,646 | 11/1986 | Crapser | 222/402.13 X |
| 4,640,443 | 2/1987 | Corsette | 222/321 |

FOREIGN PATENT DOCUMENTS

| | | | |
|---|---|---|---|
| 0090659 | 10/1983 | European Pat. Off. | 222/383 |
| 3225910 | 1/1984 | Fed. Rep. of Germany | 239/333 |
| 3315334 | 10/1984 | Fed. Rep. of Germany | 222/321 |
| 2450640 | 11/1980 | France | 239/333 |
| 2570000 | 3/1986 | France | 222/182 |
| 1085060 | 9/1967 | United Kingdom | 222/182 |

*Primary Examiner*—Kevin P. Shaver
*Attorney, Agent, or Firm*—Henry P. Nowak; James R. Nelson; Ralph W. Selitto

[57] ABSTRACT

A spraying apparatus is disclosed which employs a manually operable pump adapted to discharge a dosage of a liquid, such as a pharmaceutical preparation, from an associated container. The pump includes a reciprocating stem which extends through a screw cap of the container. An actuator is mounted on the stem of the pump for conjoint reciprocating movement therewith relative to the screw cap. Upon the extension of the actuator and hence the stem, liquid is withdrawn from the container by the pump. Upon the depression of the actuator and hence the stem, the liquid is delivered to a spray nozzle formed integrally with the actuator and then discharged from the nozzle in the form of a spray or mist. In order to ensure the smooth and effective operation of the spraying apparatus, lugs on the actuator cooperate with ribs on the screw cap to inhibit the actuator from rocking on the stem as the actuator is depressed. The lugs also cooperate with a flange on the screw cap to inhibit the actuator from being ejected by the stem of the pump during its reciprocating movement. A dust cover mounted on the actuator is provided with a plurality of resilient legs which extend through the actuator and cooperate with the screw cap to inhibit the inadvertent depression of the actuator and hence the inadvertent actuation of the pump.

17 Claims, 2 Drawing Sheets

FIG. 2
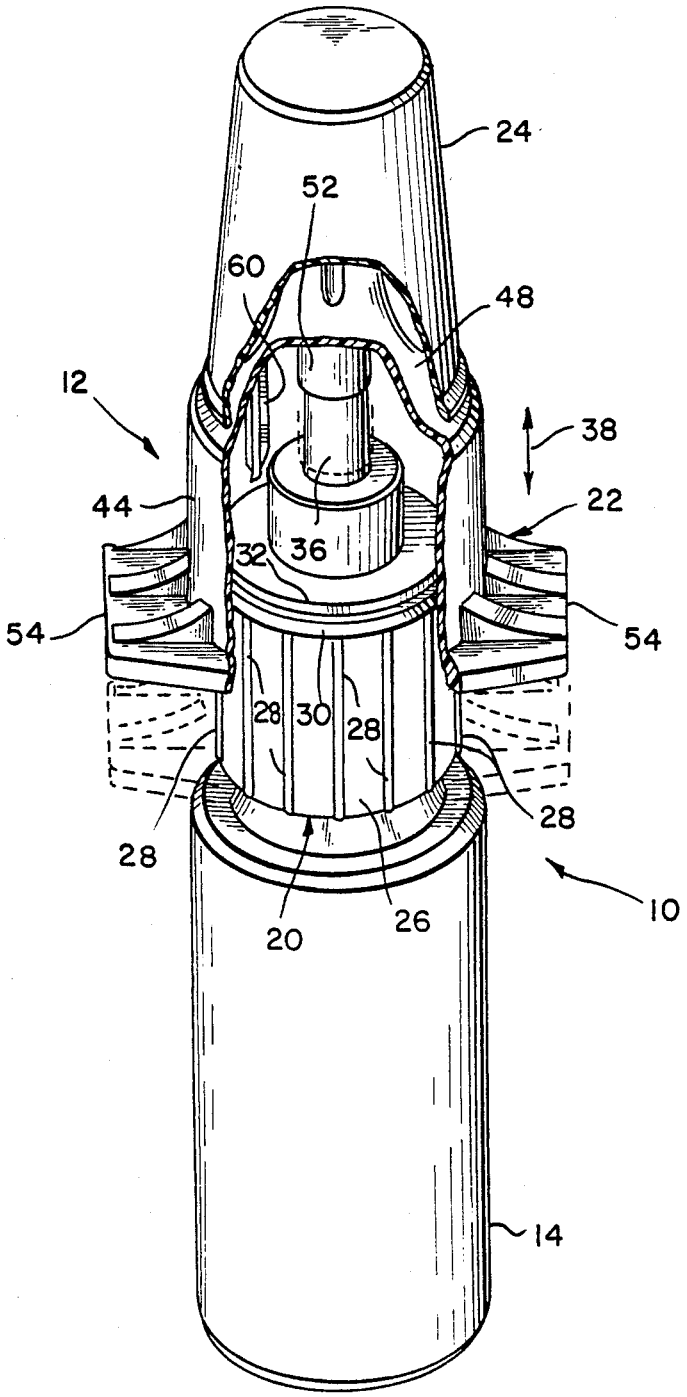
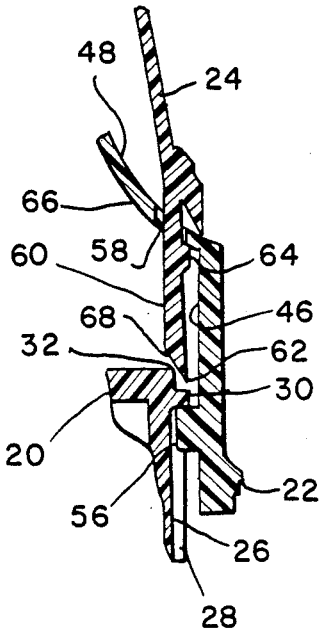
FIG. 2A

MANUALLY-OPERABLE SPRAY DISPENSER WITH LOCKING MECHANISM

FIELD OF THE INVENTION

The present invention relates to spraying apparatus, and, more particularly, to spraying apparatus equipped with a manually operable pump designed to discharge a predetermined amount of liquid, such as a pharmaceutical preparation, from a container associated with the spraying apparatus.

BACKGROUND OF THE INVENTION

Hand-held spraying apparatus have been used in the past to administer a dosage of a liquid, such as a nasal decongestant, from an associated container. One type of such spraying apparatus employs a manually operable pump which is associated with a screw cap attached to an open end of the container. The pump includes a stem adapted for movement relative to the screw cap in a reciprocating fashion. An actuator sits on the stem such that they can move conjointly in a reciprocating fashion relative to the screw cap. Upon the manual depression of the actuator, the stem is depressed to thereby withdraw a dosage of liquid from the container and deliver the dosage of liquid to a spray nozzle formed integrally with the actuator. The liquid is discharged from the nozzle in the form of a spray or mist.

The prior art spraying apparatus described above suffer from various problems. One problem is that the actuator may rock from side to side as it is being depressed in order to initiate a spraying operation, such rocking movement of the actuator oftentimes resulting in an improper dosage of liquid. Another problem involves the possibility of the actuator being inadvertently ejected from the stem of the pump when the stem returns to its extended position after being depressed. The accidental initiation of a spraying operation is a further problem of the prior art apparatus.

SUMMARY OF THE INVENTION

The present invention relates to a spraying apparatus which overcomes the problems and disadvantages of the prior art described above. More particularly, the spraying apparatus, which is adapted to withdraw a dosage of liquid from a container and then discharge the liquid in the form of a spray, includes a screw cap removably attached to the container and a pump assembly for pumping the liquid from the container. The pump assembly includes a stem which extends through the screw cap such that the stem is reciprocable relative to the screw cap between an extended position and a retracted position. An actuator adapted to actuate the pump assembly is movably mounted over and about the screw cap such that the actuator and the screw cap are arranged substantially coaxially and such that the actuator is reciprocable relative to the screw cap between an extended position and a retracted position. The actuator includes a spray nozzle adapted to spray liquid delivered thereto by the stem of the pump assembly as a result of the movement of the stem from its extended position to its retracted position in response to the movement of the actuator from its extended position to its retracted position.

In accordance with one aspect of the present invention, the spraying apparatus is provided with a stabilizing mechanism which stabilizes the actuator as it moves between its extended position and its retracted position to thereby substantially maintain the coaxial relationship between the actuator and the screw cap during such movement of the actuator. By substantially maintaining the coaxial relationship between the actuator and the screw cap, the actuator does not rock from side to side on the stem as the actuator is manually depressed in order to move it from its extended position to its retracted position. Such stabilization of the actuator promotes its smooth operation during a spraying operation to thereby ensure that the liquid discharged from the spraying apparatus is administered at its prescribed dosage. In one embodiment of this aspect, lugs on an inner cylindrical surface of the actuator cooperate with ribs on an outer cylindrical surface of the screw cap to ensure that the desired coaxial relationship between the actuator and the screw cap is maintained as the actuator moves between its extended position and its retracted position.

Another aspect of the present invention involves limiting the movement of the actuator relative to the screw cap as the actuator moves from its retracted position toward its extended position to thereby inhibit the actuator from being inadvertently ejected by the stem of the pump assembly as the stem moves from its retracted position to its extended position. In accordance with one embodiment of this aspect, the lugs on the inner cylindrical surface of the actuator engage a circular flange on the screw cap when the actuator is in its extended position, whereby the flange inhibits the actuator from being moved beyond its extended position by the stem of the pump assembly.

In accordance with a further aspect of the present invention, the spraying apparatus includes a dust cover designed to protect the spray nozzle of the actuator when the dust cover is mounted on the actuator. The dust cover is equipped with a locking mechanism which locks the actuator in a locked position when the dust cover is mounted on the actuator. The locked position corresponds generally to the extended position of the actuator such that the locking mechanism inhibits the inadvertent actuation of the pump assembly by the actuator. In one embodiment of this aspect, the locking mechanism includes a plurality of openings provided in an upper surface of the actuator and a plurality of resilient legs depending from the dust cover. Each of the legs is sized and shaped so as to extend through a corresponding one of the openings. Because a lower end of each leg is positioned in close proximity to an upper edge of the screw cap, any attempt to depress the actuator, when the dust cover is mounted thereon, will result in the legs contacting the upper edge of the screw cap. Tabs on the legs cooperate with the legs to grip the actuator and thereby inhibit any substantial relative movement between the dust cover and the actuator. Accordingly, as long as the actuator remains partially depressed, the legs are maintained in intimate contact with the upper edge of the screw cap to thereby inhibit any significant movement of the actuator toward its retracted position.

BRIEF DESCRIPTION OF THE DRAWINGS

For a better understanding of the present invention, reference is made to the following detailed description of an exemplary embodiment considered in conjunction with the accompanying drawings, in which:

FIG. 2 is a perspective view of the spraying apparatus illustrated in FIG. 1, the spraying apparatus being shown in its assembled state with portions of various components being broken away to facilitate consideration and discussion; and FIG. 2A is a fragmental, cross-sectional view of the spraying apparatus illustrated in FIG. 2.

DESCRIPTION OF THE EXEMPLARY EMBODIMENT

Figure 1:
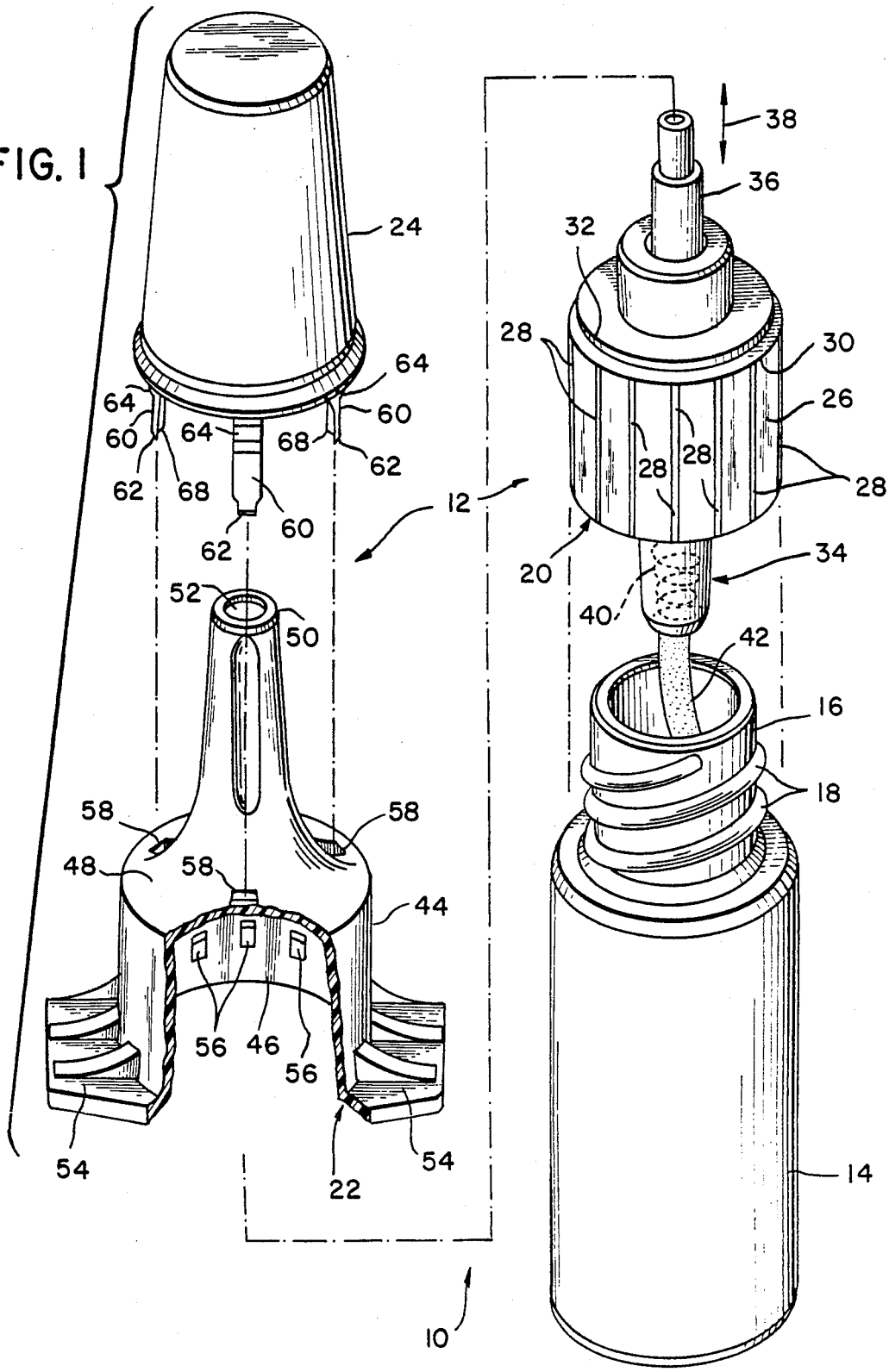
FIG. 1 is an exploded perspective view of a spraying apparatus constructed in accordance with the present invention, a portion of one component of the spraying apparatus being broken away to facilitate consideration and discussion.

Although the present invention is applicable to many different types of spraying systems, it is especially suitable for use in connection with a nasal spray assembly. Accordingly, the present invention will be described in connection with such an assembly.

With reference to FIGS. 1, 2 and 2A , there is shown a nasal spray assembly 10, including a spraying apparatus 12 and a container 14, which contains a liquid pharmaceutical preparation, such as a nasal decongestant. The container 14 has a neck 16 which is provided with external threads 18 for a purpose to be described hereinafter.

The spraying apparatus 12 includes three basic components: a screw cap 20, an actuator 22 and a dust cover 24. The spraying apparatus 12 functions so as to withdraw a dosage of the pharmaceutical preparation from the container 14 and then discharge such dosage in the form of a spray or mist.

The screw cap 20 has an outer cylindrical surface 26 and an inner cylindrical surface (not shown), which is provided with internal threads (not shown) adapted to threadedly engage the external threads 18 on the neck 16 of the container 14 so that the screw cap 20 can be screwed onto and off of the container 14. The outer cylindrical surface 26 of the cap 20 includes ribs 28, each of the ribs 28 projecting radially outwardly from the outer cylindrical surface 26 and extending along substantially the entire length of the outer cylindrical surface 26. A circular flange 30 projects radially outwardly from the outer cylindrical surface 26 and extends circumferentially about the outer cylindrical surface 26 just below an upper edge 32 thereof. A conventional pump assembly 34 is received by the screw cap 20. The pump assembly 34 includes a stem 36 which extends through the screw cap 20 in such a manner that the stem 36 can be reciprocated relative to the screw cap 20 in a direction indicated by arrow 38. Thus, the stem 36 is movable between an extended position (indicated by solid lines in FIG. 2) and a retracted position (indicated in phantom in FIG. 2). A spring 40 (shown in phantom in FIG. 1) housed in the pump assembly 34 urges the stem 36 toward its extended position. The pump assembly 34 also includes a tube 42 which draws the pharmaceutical preparation from the container 14 upon the movement of the stem 36 from its retracted position to its extended position. The pharmaceutical preparation is delivered via the tube 42 to the stem 36 and then to the actuator 22.

The actuator 22 includes an outer cylindrical surface 44, an inner cylindrical surface 46 and an upper surface 48 which tapers to a tip 50. A spray nozzle 52 is formed integrally with the the tip 50 of the actuator 22. The spray nozzle 52 extends along and within the tip 50 to the pump assembly 34, where it is seated on the stem 36 in such a manner that the actuator 22 is movable conjointly with the stem 36 (see FIG. 2). Thus, like the stem 36, the actuator 22, which is mounted over and about the screw cap 20, can reciprocate relative to the screw cap 20 in the direction of the arrow 38 between an extended position (indicated by solid lines in FIG. 2) and a retracted position (indicated in phantom in FIG. 2). Ears 54, which project radially outwardly from the outer cylindrical surface 44 of the actuator 22, can be engaged by, for instance, the index and middle finger of a user to permit the user to move the actuator 22 from its extended position to its retracted position and thereby move the stem 36 of the pump assembly 34 from its extended position to its retracted position. Upon such movement of the actuator 22 and the stem 36, the pharmaceutical preparation is delivered to the spray nozzle 52 and then discharged therefrom in the form a spray or mist.

The inner cylindrical surface 46 of the actuator 22 is provided with a series of lugs 56, each of the lugs 56 projecting radially inwardly from the inner cylindrical surface 46. The lugs 56, which are shorter but wider than the ribs 28 on the screw cap 20, extend from the inner cylindrical surface 46 a distance selected such that they are in close proximity to the outer cylindrical surface 26 of the screw cap 20, while the ribs 28 extend from the outer cylindrical surface 26 of the screw cap 20 a distance selected such that they are in close proximity to the inner cylindrical surface 46 of the actuator 22. Thus, during the movement of the actuator 22 between its extended position and its retracted position, the lugs 56 cooperate with the ribs 28 to substantially maintain the coaxial relationship which exists between the screw cap 20 and the actuator 22. By maintaining the coaxial relationship between the actuator 22 and the screw cap 20, the actuator 22 does not rock from side to side on the stem 36 of the pump assembly 34 as the actuator 22 is moved from its extended position to its retracted position. Such stabilization of the actuator 22 promotes its smooth operation during a spraying operation to thereby ensure that the pharmaceutical preparation is discharged from the spray nozzle 52 at its prescribed dosage, which is determined by the stroke of the actuator 22 and hence the stem 36.

The lugs 56 are also sized and shaped so as to engage the flange 30 on the outer cylindrical surface 26 of the screw cap 20 when the actuator 22 is in its extended position, whereby the lugs 56 and the flange 30 cooperate to define the extended position of the actuator 22 and to inhibit the actuator 22 from being moved beyond its extended position by the stem 36 of the pump assembly 34. Thus, the lugs 56 and the flange 30 cooperate to inhibit the actuator 22 from being inadvertently ejected by the stem 36 as the stem 36 is moved from its retracted position to its extended position, as well as to determine the stroke of the actuator 22 and hence the stem 36. The stroke of the actuator 22 and hence the stem 36 can be regulated by changing the location of the circular flange 30 along the length of the screw cap 20, such regulation of the stroke resulting in corresponding dosage variations. Also, by replacing the circular flange 30 with a plurality of spaced-apart, semi-circular flanges arranged at different points along the length of the screw cap 20, the pharmaceutical preparation can be discharged in various different dosages depending upon the stroke of the actuator 22 and hence the stem 36 as determined by which of the flanges engages one or more of the lugs 56.

Each of the lugs 56 is positioned between a corresponding pair of the ribs 28 provided on the outer cylindrical surface 26 of the screw cap 20. Accordingly, the lugs 56 also cooperate with the ribs 28 for the purpose of limiting the rotational movement of the actuator 22 relative to the screw cap 20.

The upper surface 48 of the actuator 22 is provided with a plurality of openings 58. The function of the openings 58 will be described hereinafter.

Resilient legs 60 depend from the dust cover 24 such that each of the legs 60 extends through a corresponding one of the openings 58 in the upper surface 48 of the actuator 22. The length of the legs 60 is selected such that a lower end 62 of each one is positioned in close proximity to the upper edge 32 of the screw cap 20 (see FIGS. 2 and 2A). A boss 64 extends outwardly from each of the legs 60, the boss 64 being sized and shaped such that after passing through a corresponding one of the openings 58 it engages an underside 66 of the upper surface 48 of the actuator 22 (see FIG. 2A). The bosses 64 thus inhibit the legs 60 from passing back through the openings 58 after the dust cover 24 has been mounted on the actuator 22. The legs 60 are flexible enough to permit them to be deflected outwardly as a result of their engagement with the upper edge 32 of the screw cap 20 during an attempt to move the actuator 22 from its extended position to its retracted position when the dust cover 24 is mounted thereon. Such deflection of the legs 60 causes the outward deflection of the bosses 64 to thereby further inhibit the legs 60 from passing back through the openings 58 in the upper surface 48 of the actuator 22. Thus, the legs 60 and the bosses 64 cooperate to grip the actuator 22 and thereby inhibit any substantial relevant movement between the dust cover 24 and the actuator 22. Of course, the gripping action of the legs 60 and the bosses 64 is not so great as to prevent the manual removal of the dust cover 24 by a user.

The lower ends 62 of the legs 60 are provided with a surface 68, which is contoured (i.e., beveled or curved) and which is located so as to engage the upper edge 32 of the screw cap 20 during an attempt to move the actuator 22 from its extended position to its retracted position when the dust cover 24 is mounted thereon (see FIG. 2A). The shape of the contoured surfaces 68 is selected so as to promote the deflection of the legs 60. Because the lower ends 62 of the legs 60 are mounted in close proximity to the upper edge 32 of the screw cap 20, the legs 60 permit very limited downward movement of the actuator 22 when the dust cover 24 is mounted thereon. Thus, the legs 60 cooperate with the upper edge 32 of the cap 20 to effectively lock the actuator 22 in its extended position when the dust cover 24 is mounted thereon, whereby the inadvertent actuation of the pump assembly 34 by the actuator 22 is inhibited.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

We claim:

1. Spraying apparatus for withdrawing a dosage of liquid from a container and discharging the dosage of liquid in the form of a spray, comprising a cap removably attachable to a container of liquid; pumping means for pumping liquid from a container attached to said cap, said pumping means including a stem extending through said cap such that said stem is reciprocable relative to said cap between an extended position and a retracted position; actuating means for actuating said pumping means, said actuating means being movably mounted over and about said cap such that said actuating means is reciprocable relative to said cap between an extended position and a retracted position and said actuating means including spraying means for spraying liquid delivered thereto by said stem upon the movement of said stem from its extended position to its retracted position in response to the movement of said actuating means from its extended position to its retracted position; covering means for covering said spraying means when said covering means is mounted on said actuating means; and locking means for locking said actuating means in a locked position when said covering means is mounted on said actuating means, said locked position corresponding generally to said extended position of said actuating means, whereby said locking means inhibits the inadvertent actuation of said pumping means by said actuating means, said locking means including a plurality of openings provided in an upper surface of said actuating means and a plurality of resilient legs depending from said covering means, each of said legs being sized and shaped so as to extend through a corresponding one of said openings and having a lower end which is positioned in close proximity to an upper edge of said cap.

2. Spraying apparatus according to claim 1, wherein each of said legs further includes a boss extending outwardly therefrom such that said boss engages an underside of said upper surface of said actuating means, whereby said boss inhibits its associated leg from passing back through said corresponding one of said openings after said covering means has been mounted on said actuating means.

3. Spraying apparatus according to claim 2, wherein each of said legs is sufficiently flexible to permit it to be deflected outwardly as a result of its engagement with said upper edge of said cap during an attempt to move said actuating means from its extended position to its retracted position when said covering means is mounted on said actuating means, such deflection of said leg causing the outward deflection of its associated boss to thereby further inhibit said leg from passing back through said corresponding one of said openings, whereby said legs and said bosses cooperate to grip said actuating means so as to inhibit any substantial relative movement between said covering means and said actuating means.

4. Spraying apparatus according to claim 1, wherein said lower end of each of said legs has a contoured surface located so as to engage said upper edge of said cap during an attempt to move said actuating means from its extended position to its retracted position when said covering means is mounted on said actuating means, the shape of said contoured surface being selected so as to promote the deflection of its associated leg.

5. Spraying apparatus according to claim 4, wherein said actuating means is manually movable from its extended position to its retracted position when said covering means is removed from said actuating means.

6. Spraying apparatus for withdrawing a dosage of liquid from a container and discharging the dosage of liquid in the form of a spray, comprising a cap removably attachable to a container of liquid; pumping means for pumping liquid from a container attached to said cap, said pumping means including a stem extending through said cap such that said stem is reciprocable relative to said cap between an extended position and a retracted position; actuating means for actuating said pumping means, said actuating means being movably mounted over and about said cap such that said actuating means is reciprocable relative to said cap between an extended position and a retracted position and said actuating means including a plurality of openings provided in an upper surface thereof and spraying means for spraying liquid delivered thereto by said stem upon the movement of said stem from its extended position to its retracted position in response to the movement of said actuating means from its extended position to its retracted position; covering means removably mounted on said actuating means for covering said spraying means when said covering means is mounted on said actuating means, said covering means being movable conjointly with said actuating means and including locking means formed integrally with said covering means for locking said actuating means in a locked position in response to the movement of said actuating means from its extended position toward its retracted position, said locking means depending from said covering means and extending through said openings in said upper surface of said actuating means to a point in close proximity to said cap said point being located such that said locking means is suspended a predetermined distance above said cap by said covering means, and said locked position being located such that it corresponds generally to said extended position of said actuating means and such that it is reached when said locking means moves said predetermined distance and engages said cap to thereby arrest the movement of said covering means and hence said actuating means relative to said cap, whereby said locking means inhibits the inadvertent actuation of said pumping means by said actuating means.

7. Spraying apparatus according to claim 6, wherein said locking means includes a plurality of resilient legs depending from said covering means, each of said legs being sized and shaped so as to extend through a corresponding one of said openings and having a lower end which is positioned in close proximity to an upper edge of said cap.

8. Spraying apparatus according to claim 7, wherein each of said legs further includes a boss extending outwardly therefrom such that said boss engages an underside of said upper surface of said actuating means, whereby said boss inhibits its associated leg from passing back through said corresponding one of said openings after said covering means has been mounted on said actuating means.

9. Spraying apparatus according to claim 8, wherein each of said legs is sufficiently flexible to permit it to be deflected outwardly as a result of its engagement with said upper edge of said cap during an attempt to move said actuating means from its extended position to its retracted position when said covering means is mounted on said actuating means, such deflection of said leg causing the outward deflection of its associated boss to thereby further inhibit said leg from passing back through said corresponding one of said openings, whereby said legs and said bosses cooperate to grip said actuating means so as to inhibit any substantial relative movement between said covering means and said actuating means.

10. Spraying apparatus according to claim 7, wherein said lower end of each of said legs has a contoured surface located so as to engage said upper edge of said cap during an attempt to move said actuating means from its extended position to its retracted position when said covering means is mounted on said actuating means, the shape of said contoured surface being selected so as to promote the deflection of its associated leg.

11. Spraying apparatus according to claim 10, wherein said actuating means is manually movable from its extended position to its retracted position when said covering means is removed from said actuating means.

12. Spraying apparatus for withdrawing a dosage of liquid from a container and discharging the dosage of liquid in the form of a spray, comprising a cap removably attachable to a container of liquid; pumping means for pumping liquid from a container attached to said cap, said pumping means including a stem extending through said cap such that said stem is reciprocable relative to said cap between an extended position and a retracted position; actuating means for actuating said pumping means, said actuating means being movably mounted over and about said cap such that said actuating means and said cap are arranged substantially coaxially and such that said actuating means is reciprocable relative to said cap between an extended position and a retracted position and said actuating means including spraying means seated on said stem of said pumping mans for spraying liquid delivered to said spraying means by said stem upon the movement of said stem from its extended position to its retracted position in response to the movement of said actuating means from its extended position to its retracted position, said spraying means including urging means for urging said stem of said pumping means into its extended position, whereby said actuating is urged into its extended position by said stem, said urging means including a spring; stabilizing means provided on said cap and said actuating means for stabilizing said actuating means as it moves between its extended position and its retracted position and for inhibiting said actuating means from rocking while said spraying means is seated on said stem, whereby the coaxial relationship between said actuating means and said cap is substantially maintained during such movement of said actuating means, said stabilizing means including a plurality of lugs extending radially inwardly from an inner cylindrical surface of said actuating means and a plurality of ribs extending radially outwardly from an outer cylindrical surface of said cap, said lugs being shorted but wider than said ribs, each of said lugs being positioned between a corresponding pair of said ribs, whereby said lugs cooperate with said ribs to limit the rotational movement of said actuating means relative to said cap, and extending from said inner cylindrical surface of said actuating means a distance selected such that said lugs are in close proximity to said outer cylindrical surface of said cap, and each of said ribs extending from said outer cylindrical surface of said cap a distance selected such that said ribs are in close proximity to said inner cylindrical surface of said actuating means and extending from a lower portion of said outer cylindrical surface of said cap to an upper portion of said outer cylindrical surface of said cap, whereby each of said ribs extends along substantially the entire length of said outer cylindrical surface of said cap; limiting means for limiting the movement of said actuating means relative to said cap as said actuating means moves from its retracted position toward its extended position, whereby said limiting means inhibits said actuating means from being inadvertently ejected by said stem of said pumping means as said stem moves from its retracted position to its extended position, said limiting means including at least one flange extending radially outwardly from said outer cylindrical surface of said cap, said at least one flange extending circumferentially about said outer cylindrical surface of said cap beneath an upper edge thereof and engaging said lugs on said actuating means when said actuating means is in its extended position, whereby said limiting means determines said extended position of said actuating means as well as its stroke; covering means for covering said spraying means when said covering means is mounted on said actuating means; and locking means for locking said actuating means in a locked position when said covering means is mounted on said actuating means, said locked position corresponding generally to said extended position of said actuating means, whereby said locking means inhibits the inadvertent actuation of said pumping means by said actuating means, said locking means including a plurality of openings provided in an upper surface of said actuating means and a plurality of resilient legs depending from said covering means, each of said legs being sized and shaped so as to extend through a corresponding one of said openings and having a lower end which is positioned in close proximity to an upper edge of said outer cylindrical surface of said cap.

13. Spraying apparatus according to claim 12, wherein each of said legs further includes a boss extending outwardly therefrom such that said boss engages an underside of said upper surface of said actuating means, whereby said boss inhibits its associated leg from passing back through said corresponding one of said openings after said covering means has been mounted on said actuating means.

14. Spraying apparatus according to claim 13, wherein each of said legs is sufficiently flexible to permit it to be deflected outwardly as a result of its engagement with said upper edge of said outer cylindrical surface of said cap during an attempt to move said actuating means from its extended position to its retracted position when said covering means is mounted on said actuating means, such deflection of said leg causing the outward deflection of its associated boss to thereby further inhibit said leg from passing back through said corresponding one of said openings, whereby said legs and said bosses cooperate to grip said actuating means so as to inhibit any substantial relative movement between said covering means and said actuating means.

15. Spraying apparatus according to claim 14, wherein said lower end of each of said legs has a contoured surface located so as to engage said upper edge of said cylindrical surface of said cap during an attempt to move said actuating means from its extended position to its retracted position when said covering means is mounted on said actuating means, the shape of said contoured surface being selected so as to promote the deflection of its associated leg.

16. Spraying apparatus according to claim 15, wherein said actuating means is manually movable from its extended position to its retracted position when said covering means is removed from said actuating means.

17. Spraying apparatus according to claim 16, wherein said cap is threadedly attached to a container which holds a pharmaceutical preparation.

* * * * *